US010626641B2

(12) United States Patent
Ueno et al.

(10) Patent No.: US 10,626,641 B2
(45) Date of Patent: Apr. 21, 2020

(54) DOOR CHECK APPARATUS

(71) Applicant: AISIN SEIKI KABUSHIKI KAISHA, Kariya-shi, Aichi-ken (JP)

(72) Inventors: Takayuki Ueno, Toyoake (JP); Masato Abe, Kariya (JP); Dai Hidaka, Obu (JP); Hirokazu Suzumura, Aichi-ken (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 16/180,188

(22) Filed: Nov. 5, 2018

(65) Prior Publication Data

US 2019/0145137 A1 May 16, 2019

(30) Foreign Application Priority Data

Nov. 15, 2017 (JP) ..... 2017-220285

(51) Int. Cl.
*E05C 17/22* (2006.01)
*E05C 17/20* (2006.01)
(Continued)

(52) U.S. Cl.
CPC ..... *E05C 17/203* (2013.01); *E05F 5/00* (2013.01); *E05F 5/06* (2013.01);
(Continued)

(58) Field of Classification Search
CPC ... Y10T 16/61; Y10T 16/629; Y10T 16/6295; Y10T 292/285; Y10T 292/286; Y10T 292/304; E05C 17/025; E05C 17/04; E05C 17/12; E05C 17/20; E05C 17/203; E05C 17/206; E05C 17/22; E05C 17/26; E05C 17/24; E05C 17/28; E05C 17/18; E05F 5/025; E05F 5/08; F05F 5/06; F05F 5/08;
(Continued)

(56) References Cited

U.S. PATENT DOCUMENTS 2,371,336 A * 3/1945 Levon ..... E05F 15/622 49/340
7,500,711 B1 * 3/2009 Ewing ..... E05F 15/622 296/146.1
(Continued)

FOREIGN PATENT DOCUMENTS

DE 102011056225 A1 6/2013
JP 2009520893 A 5/2009
WO 2016091243 A1 6/2016

*Primary Examiner* — Chuck Y Mah
(74) *Attorney, Agent, or Firm* — Buchanan Ingersoll & Rooney PC

(57) ABSTRACT

A door check apparatus includes a base member configured to be attached to a vehicle door, a threaded rod rotatably held by the base member, a first tubular member including a distal end portion configured to be connected to a vehicle main body, and a base portion. The threaded rod is arranged inside the first tubular member. At least a part of the first tubular member threadedly engages with the threaded rod. The first tubular member performs a relative movement in an axial direction relative to the threaded rod such that the first tubular member causes the threaded rod to rotate. The door check apparatus includes a brake mechanism configured to restrict the threaded rod from rotating.

8 Claims, 7 Drawing Sheets

(51) Int. Cl.
*E05F 5/06* (2006.01)
*E05F 5/00* (2017.01)

(52) U.S. Cl.
CPC ... *E05Y 2201/224* (2013.01); *E05Y 2201/702* (2013.01); *E05Y 2900/531* (2013.01)

(58) Field of Classification Search
CPC ..... F05F 5/12; E05Y 2900/531; E05Y 2201/224; E05Y 2201/248; E05Y 2201/25; E05Y 2201/696; E05Y 2201/702
See application file for complete search history.

(56) References Cited

U.S. PATENT DOCUMENTS

| | | | | |
|---|---|---|---|---|
| 8,234,817 | B2 | 8/2012 | Neundorf et al. | |
| 9,259,996 | B2 * | 2/2016 | Anderson | E05D 15/0621 |
| 2014/0150581 | A1 * | 6/2014 | Scheuring | B60J 5/047 74/89.38 |
| 2015/0059250 | A1 * | 3/2015 | Miu | E05F 15/611 49/349 |
| 2016/0052375 | A1 * | 2/2016 | Scheuring | B60J 5/047 74/89.38 |
| 2017/0145728 | A1 * | 5/2017 | Scheuring | B60J 5/047 |
| 2017/0292311 | A1 * | 10/2017 | Podkopayev | E05F 15/622 |
| 2017/0350175 | A1 | 12/2017 | Hoffmann et al. | |
| 2018/0044965 | A1 * | 2/2018 | Takizawa | E05F 15/622 |

* cited by examiner

DOOR CHECK APPARATUS

CROSS REFERENCE TO RELATED APPLICATIONS

This application is based on and claims priority under 35 U.S.C. § 119 to Japanese Patent Application 2017-220285, filed on Nov. 15, 2017, the entire content of which is incorporated herein by reference.

TECHNICAL FIELD

This disclosure generally relates to a door check apparatus.

BACKGROUND DISCUSSION

As disclosed in DE Patent application publication No. 102011056225A1 (which will be hereinafter referred to as Patent reference 1), generally, a known door check apparatus is provided between a vehicle main body and a vehicle door, and generates a resistance force (which will be hereinafter referred to as a holding force) against an opening and closing operation of the vehicle door. The holding force acts, at a hinge portion between the vehicle door and the vehicle main body, to hold a distance between the vehicle door and the vehicle main body.

When an opening-and-closing-operation force which is greater than the holding force is inputted to the vehicle door, the vehicle door opens and closes. The door check apparatus can restrict the vehicle door from performing the opening and closing operation against an intention of a user, for example, in a case where the vehicle door is kept open at a predetermined opening degree on a hill road and the vehicle door happens to close, or in a case where the vehicle opens widely further from a desired opening degree when the vehicle door is fanned by a wind or the like.

A door check apparatus disclosed in Patent reference 1 generates the above-described holding force with the use of a nut and a spindle (threaded rod). Specifically, the nut is arranged to be rotatable at a predetermined position at an inside of a vehicle door, and the spindle is connected to a vehicle main body side. The spindle moves in an axial direction in response to an opening and closing operation of the vehicle door. The nut and the spindle are threadedly engaged with each other, and a linear motion of the spindle is converted into a rotational motion of the nut. By controlling the rotations of the nut with a brake mechanism, the linear motion of the spindle (the movement of the spindle) can be stopped at an arbitrary position. Thus, the door check apparatus can generate the holding force at a position with an arbitrary opening degree (for example, a position at which a user stopped the opening and closing operation of the vehicle door).

According to the door check apparatus disclosed in Patent reference 1, in response to the opening and closing operation of the vehicle door, the spindle that is in the non-rotating state moves in the axial direction relative to the nut rotating at the predetermined position. It is configured such that the spindle itself is exposed outside at the hinge portion between the vehicle door and the vehicle main body in a state where the vehicle door is open. Thus, in a case where any specific measure has not been taken, rainwater and/or dust is likely to attach to an outer circumferential surface of the spindle. The adhesion of the rainwater and/or dust might lead to malfunction and/or occurrence of abnormal noises, and/or might shorten a service life of the door check apparatus.

A need thus exists for a door check apparatus which is not susceptible to the drawback mentioned above.

SUMMARY

According to an aspect of this disclosure, a door check apparatus includes a base member configured to be attached to a vehicle door, a threaded rod rotatably held by the base member, and a first tubular member including a distal end portion configured to be connected to a vehicle main body, and a base portion positioned at a side opposite to the distal end portion. The threaded rod is arranged inside the first tubular member. At least a part of the first tubular member, the part which is between the distal end portion and the base portion, threadedly engages with the threaded rod. The first tubular member performs a relative movement in an axial direction relative to the threaded rod in response to an opening and closing operation of the vehicle door such that the first tubular member causes the threaded rod to rotate. The door check apparatus includes a brake mechanism configured to restrict the threaded rod from rotating such that the brake mechanism restricts the first tubular member from performing the relative movement relative to the threaded rod.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of the disclosure will be explained hereunder with reference to the drawings. In the explanations below, the identical numerical designation is given to the identical component and the corresponding component, and duplicate explanations thereof might be omitted.

Figure 1:
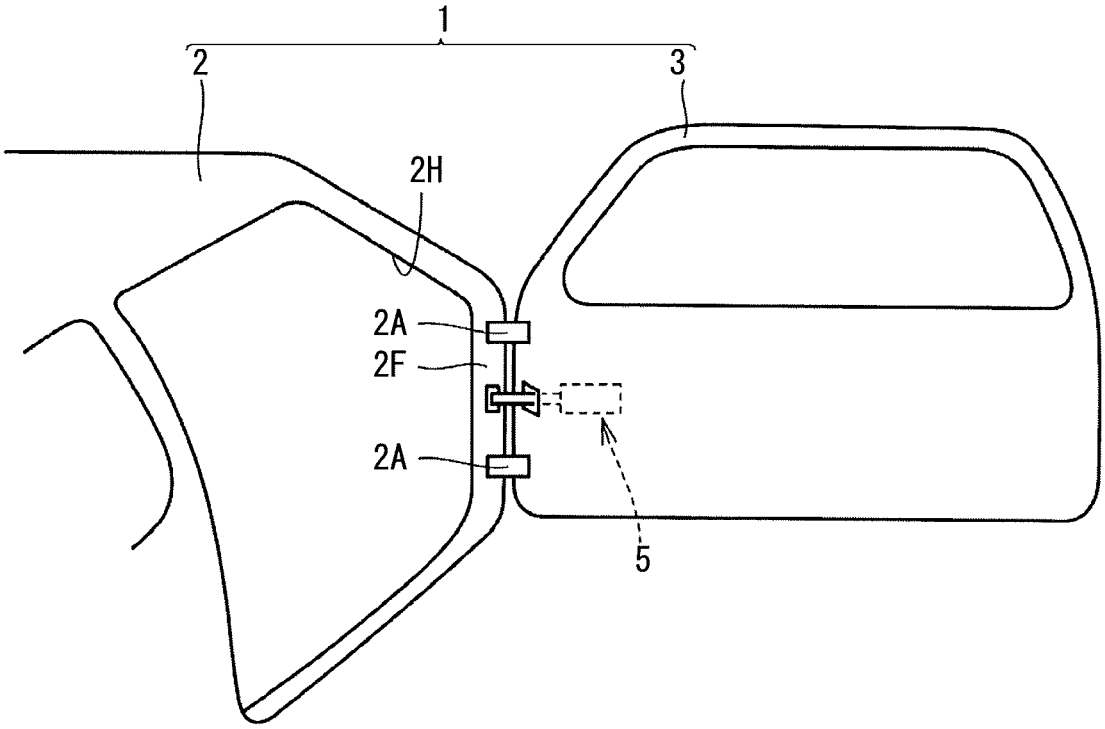
FIG. 1 is; a schematic view of a vehicle to which a door check apparatus according to an embodiment disclosed here is configured to be mounted.

A vehicle 1 will be explained. FIG. 1 is a schematic view of the vehicle 1 to which a door check apparatus 5 is configured to be mounted. As illustrated in FIG. 1, the vehicle 1 includes a vehicle main body 2 and a vehicle door 3. An ingress-and-egress opening 2H is provided at a side portion of the vehicle main body 2. A pair of door hinges 2A, 2A is attached to a front edge portion 2F of the ingress-and-egress opening 2H. The vehicle door 3 is connected to the vehicle main body 2 to be able to swing or pivot relative to the vehicle main body 2 via the pair of door hinges 2A, 2A.

Figure 2:
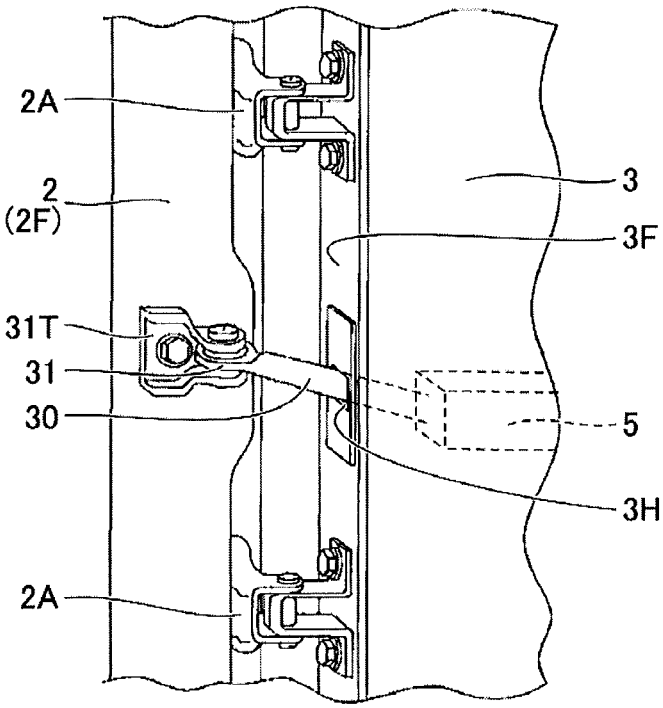
FIG. 2 is an enlarged view illustrating a hinge portion between a vehicle main body and a vehicle door according to the embodiment disclosed here.

FIG. 2 is an enlarged view illustrating a hinge portion between the vehicle main body 2 and the vehicle door 3. As illustrated in FIG. 2, an opening portion 3H is provided at a front end portion 3F of the vehicle door 3. The door check apparatus 5 is arranged at an inner portion of the vehicle door 3. A first tubular member 30 serving as a component of the door check apparatus 5 projects to an outside of the vehicle door 3 via the opening portion 3H. A distal end portion 31 of the first tubular member 30 is to be fixed to the front edge portion 2F of the vehicle main body 2 via a bracket 31T.

Figure 3:
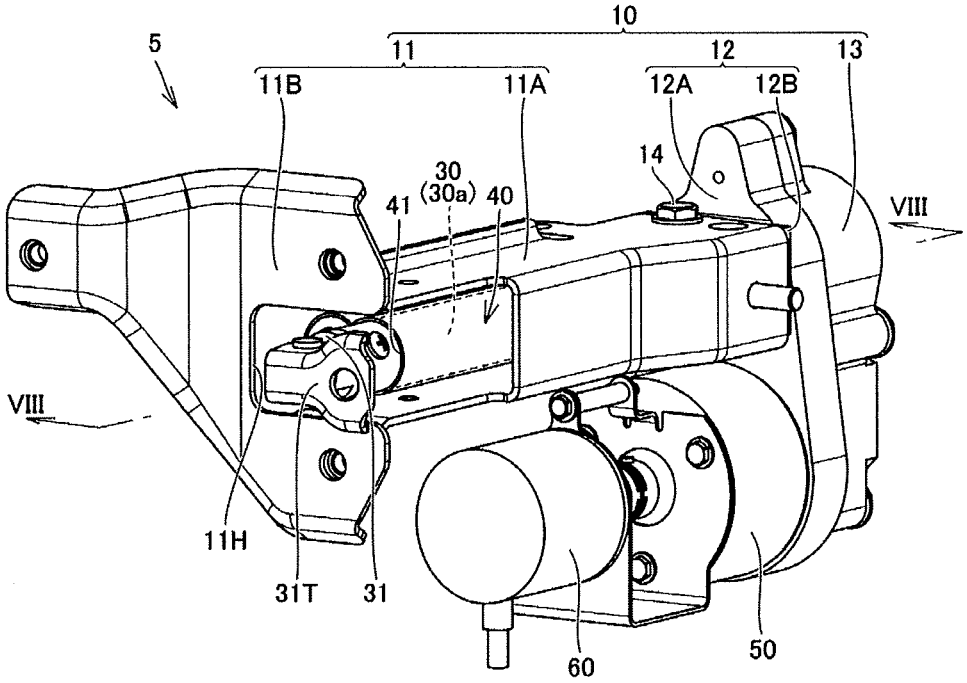
FIG. 3 is a perspective view illustrating the door check apparatus, in which a configuration of a front side (distal end side) of the door check apparatus and a configuration of an inner side, in a vehicle width direction, of the door check apparatus are illustrated.
Figure 4:
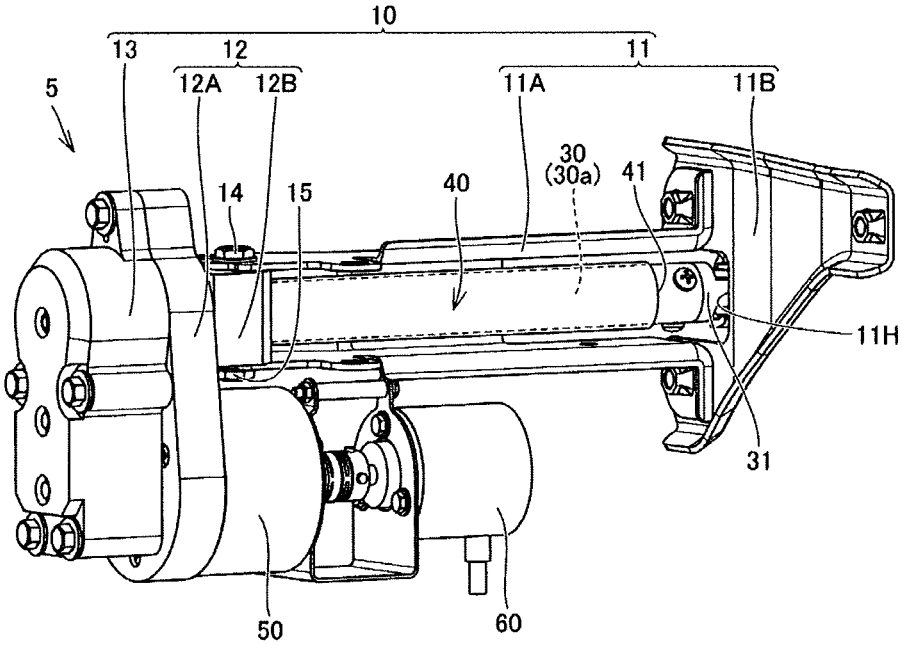
FIG. 4 is another perspective view illustrating the door check apparatus, in which a configuration of a rear side of the door check apparatus and a configuration of an outer side, in the vehicle width direction, of the door check apparatus are illustrated.
Figure 5:
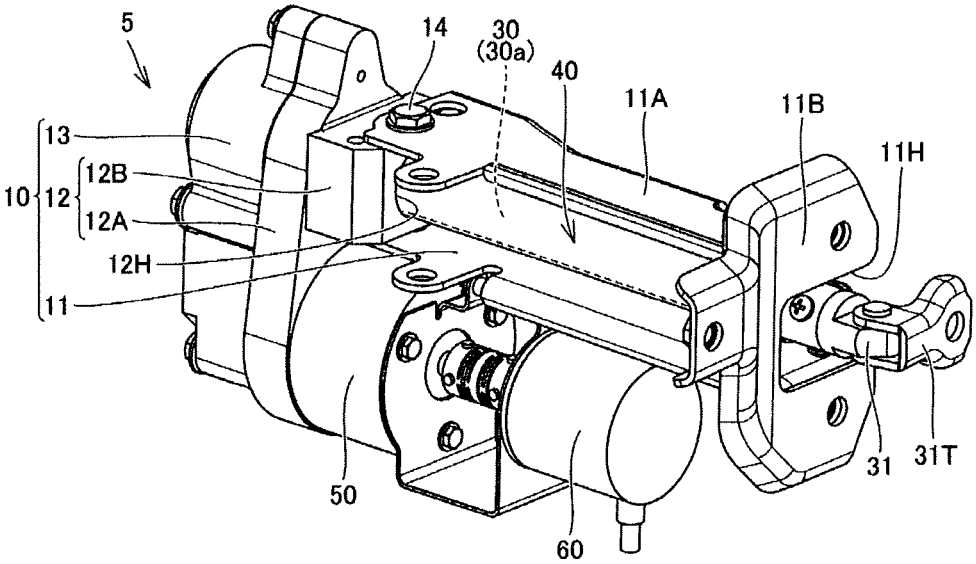
FIG. 5 is another perspective view illustrating the door check apparatus, in which the configuration of the front side (distal end side) of the door check apparatus and the configuration of the outer side, in the vehicle width direction, of the door check apparatus are illustrated.

The door check apparatus 5 will be explained. FIG. 3 is a perspective view illustrating the door check apparatus 5. FIG. 5 illustrates a structure of a front side (distal end side) of the door check apparatus 5 and a structure of an inner side, in a vehicle width direction, of the door check apparatus 5. FIG. 4 is another perspective view illustrating the door check apparatus 5. FIG. 4 illustrates a structure of a rear side of the door check apparatus 5 and a structure of an outer side, in the vehicle width direction, of the door check apparatus 5. FIG. 5 is another perspective view illustrating the door check apparatus 5. FIG. 5 illustrates the structure of the front side (distal end side) of the door check apparatus 5 and the structure of the outer side, in the vehicle width direction, of the door check apparatus 5.

Figure 6:
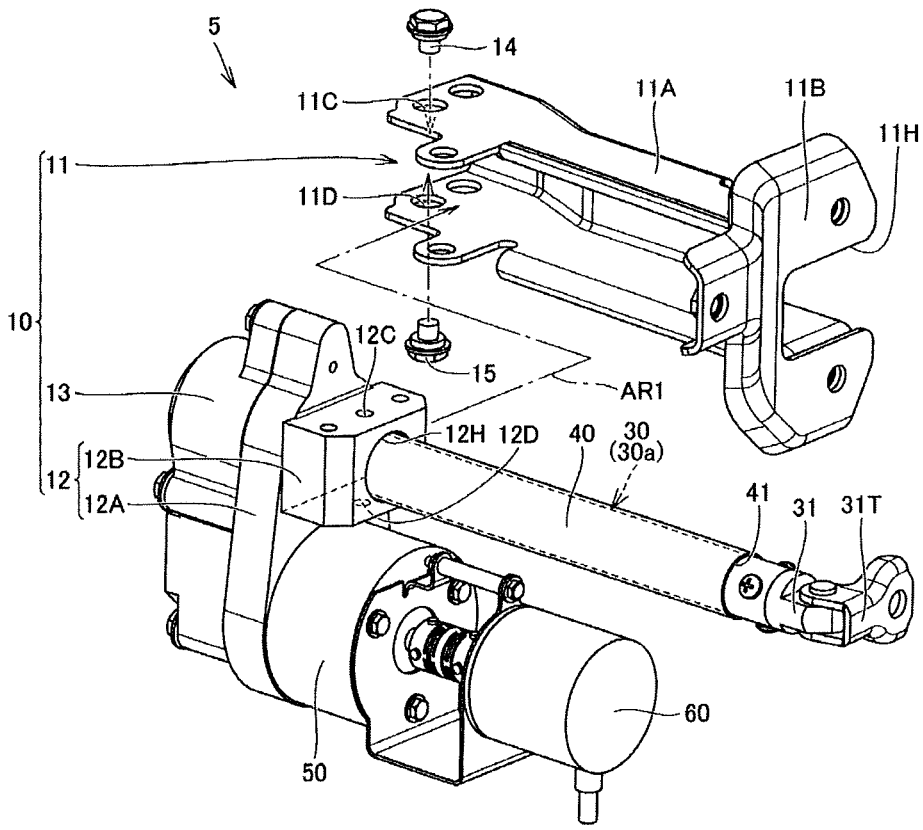
FIG. 6 is a perspective view illustrating a state in which the door check apparatus illustrated in FIG. 5 is disassembled or dismantled, in which a holding member of a base member is separated from a lid member (a pedestal portion) of the base member.
Figure 7:
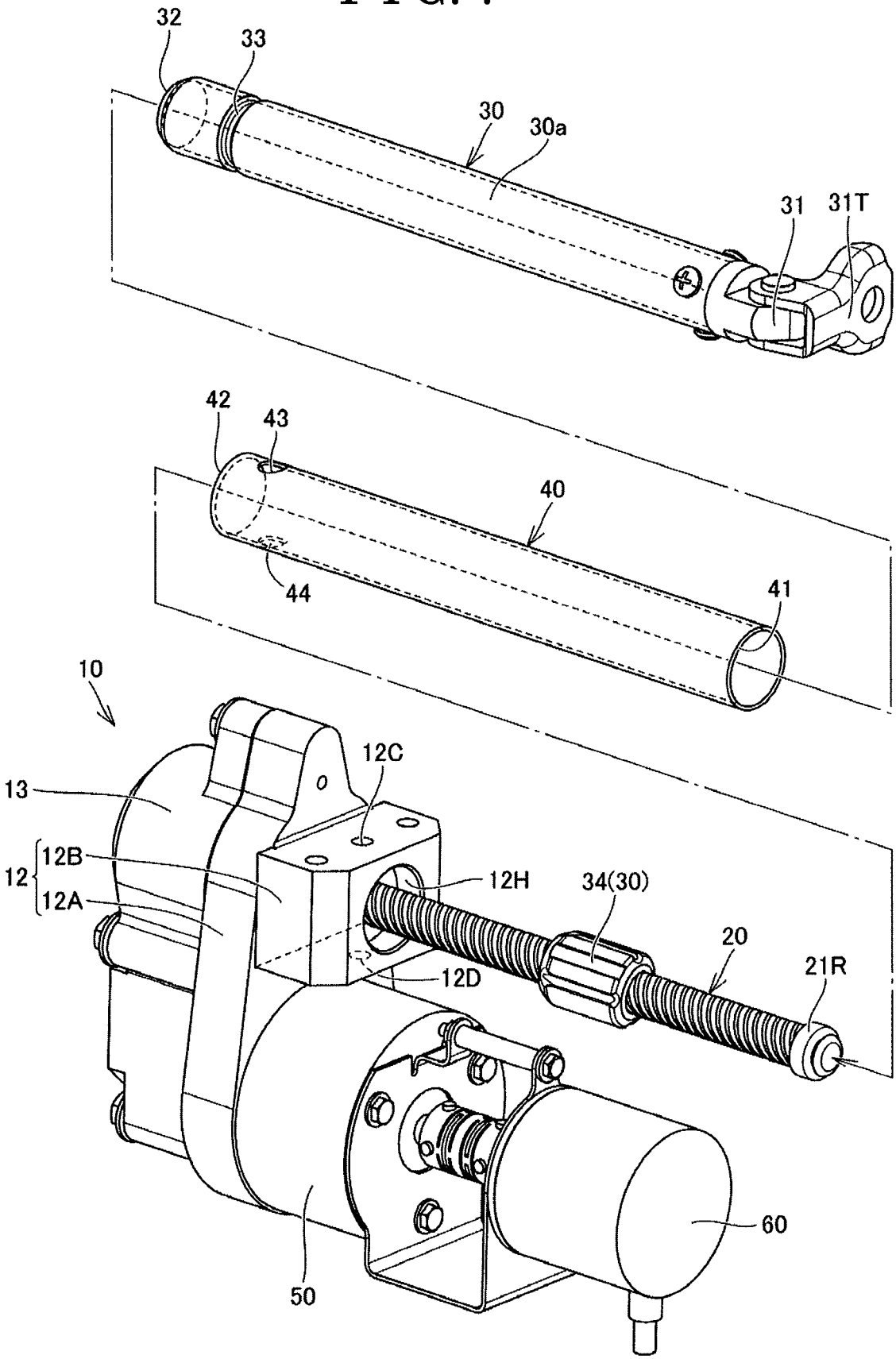
FIG. 7 illustrates a state in which a first tubular member and a second tubular member according to the embodiment disclosed here, which are illustrated in FIG. 6, are separated from the lid member (pedestal portion) of the base member.
Figure 8:
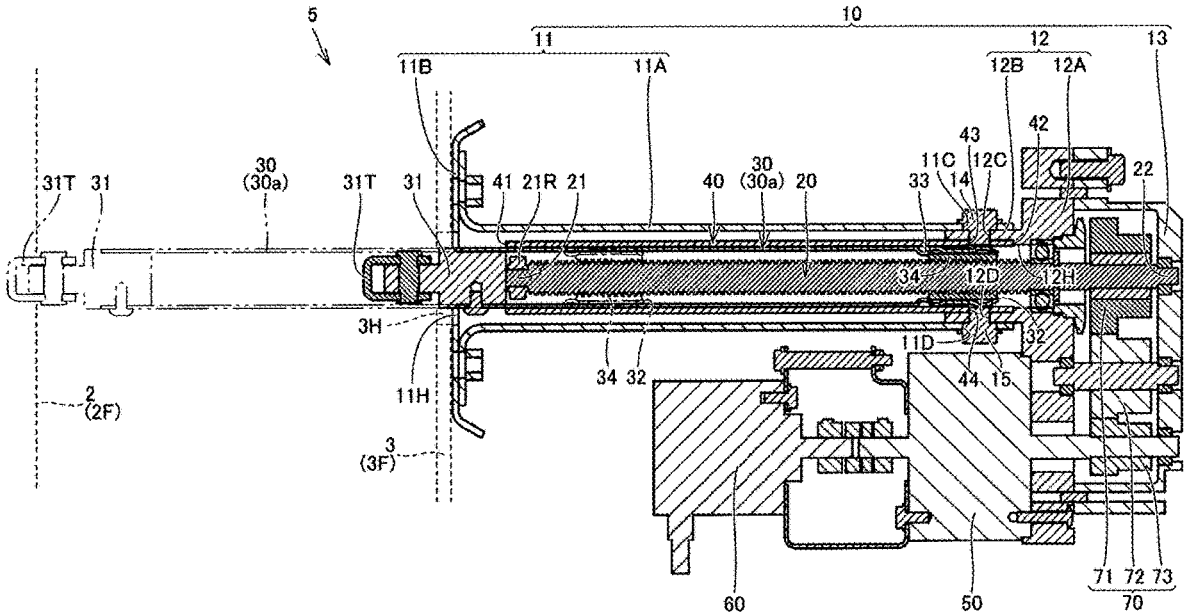
FIG. 8 is a cross-sectional view taken along line VIII-VIII of FIG. 3 and seen in the direction of the arrow of FIG. 3.

FIG. 6 is a perspective view illustrating a state in which the door check apparatus 5 illustrated in FIG. 5 is disassembled or dismantled. FIG. 6 illustrates a state in which a holding member 11 of the base member 10 is separated from a lid member 12 (a pedestal portion 12B) of the base member 10. FIG. 7 illustrates a state in which the first tubular member 30 and a second tubular member 40, which are illustrated in FIG. 6, are separated from the lid member 12 (pedestal portion 12B) of the base member 10. FIG. 8 is a cross-sectional view taken along line VIII-VIII of FIG. 3 and seen in the direction of the arrow of FIG. 3.

As illustrated in FIGS. 3 to 8 (mainly in FIGS. 7 and 8), the door check apparatus 5 includes the base member 10, a threaded rod 20 (FIGS. 7 and 8), the first tubular member 30, the second tubular member 40, a brake mechanism 50, an encoder 60 and a speed increasing mechanism 70 (FIG. 8). The above-stated components will be explained hereunder in the mentioned order.

The base member 10 will be explained. The base member 10 includes the holding member 11, the lid member 12 and a case body 13. The holding member 11 includes an extended portion 11A and an attachment portion 11B. The extended portion 11A includes an upper plate, a bottom plate and a side plate, and includes a cross-section of a substantially C shape (or a cross-section of a substantially three-sided rectangular shape) as a whole. For example, the threaded rod 20, the first tubular member 30 and the second tubular member 40, which will be described later, are arranged at an inner side of the extended portion 11A (an arrow AR1 of FIG. 6). In a state where the door check apparatus 5 is attached to the vehicle door 3 (FIG. 8) (in a state where the vehicle door 3 is closed), the extended portion 11A extends in a direction which is substantially parallel with a vehicle front and rear direction (the right and left direction on the paper surface of FIG. 8).

A through hole 110 (FIG. 6) is provided at the upper plate of the extended portion 11A. A fastening member 14 is inserted through the through hole 110 and the inserted fastening member 14 threadedly engages with or is screwed in a screw hole 12C provided at the pedestal portion 12B that will be explained later. A through hole 11D (FIG. 6) is provided at the bottom plate of the extended portion 11A. A fastening member 15 is inserted through the through hole 11D and the inserted fastening member 15 threadedly engages with a screw hole 12D provided at the pedestal portion 12B that will be explained later. The holding member 11 (extended portion 11A) and the lid member 12 (pedestal portion 12B) can pivot or swing relative to each other while a position of the fastening members 14 and 15 serving as a center of the pivot.

The attachment portion 11B of the holding member 11 includes a plate shape and is provided at a distal end of the extended portion 11A such that the attachment portion 11B is substantially orthogonal to an extended direction of the extended portion 11A. The attachment portion 11B is configured to be attached to the front end portion 3F (FIGS. 2 and 8) of the vehicle door 3 with the use of a fastening member. An opening portion 11H is provided at the attachment portion 11B. The first tubular member 30 arranged inside the extended portion 11A is configured to move in a direction in which the first tubular member 30 projects from the attachment portion 11B through the opening portion 11H and in a direction which is opposite to the above-explained direction in which the first tubular member 30 projects (the details will be mentioned later).

The lid member 12 includes a plate portion 12A and the pedestal portion 12B. The plate portion 12A is provided at a rear end of the extended portion 11A to be substantially orthogonal to the extended direction of the extended portion 11A (FIGS. 6 and 8). The pedestal portion 12B is formed to protrude from a surface of the plate portion 12A, the surface which is at a side at which the extended portion 11A is arranged. The screw hole 12C is provided at an upper surface of the pedestal portion 12B and the screw hole 12D is provided at a bottom surface of the pedestal portion 12B.

A through hole 12H is provided at the pedestal portion 12B. The through hole 12H is formed to penetrate the lid member 12 in such a manner that the through hole 12H reaches a rear surface of the plate portion 12A from a surface of the pedestal portion 12B, the surface which is at a side at which the extended portion 11A is arranged (FIGS. 7 and 8). The case body 13 includes a bottomed cylindrical or a bottomed tubular shape. The lid member 12 is attached to the case body 13 to cover an opening of the case body 13. The speed increasing mechanism 70 (FIG. 8), which will be explained later, is arranged in a space portion defined by the case body 13 and the lid member 12.

The threaded rod 20 will be explained. As illustrated in FIGS. 7 and 8, the threaded rod 20 includes a shape extended linearly from a distal end 21 (FIG. 8) towards a rear end 22 (FIG. 8). Threads are provided at an outer circumferential surface of the threaded rod 20 to extend in a spiral manner. The threaded rod 20 is inserted through the through hole 12H of the lid member 12. The rear end 22 of the threaded rod 20 is rotatably held by the case body 13 of the base member 10 via a bearing. A portion of the threaded rod 20, the portion which is close to the rear end 22, is rotatably held by the lid member 12 (plate portion 12A) of the base member 10 via a bearing.

The speed increasing mechanism 70 includes gears 71, 72 and 73. The gear 71 is connected to the threaded rod 20 at a portion close to the rear end 22. The threaded rod 20 rotates integrally with the gear 71. Speed of the rotations of the threaded rod 20 is increased by the gears 71, 72 and 73 (FIG. 8), which form the speed increasing mechanism 70, and the rotations are transmitted to the brake mechanism 50 in a state where the speed of the rotations has been increased. A nut 34 (FIG. 7) serving as a component element of the first tubular member 30 is fitted to the threaded rod 20 to threadedly engage with the threaded rod 20. After the nut 34 is fitted to the threaded rod 20 together with the first tubular member 30 that will be explained below, a fastening member 21R is attached to the distal end 21 of the threaded rod 20.

The first tubular member 30 will be explained. As illustrated in FIGS. 7 and 8, the first tubular member 30 includes a tube portion 30*a* and the nut 34 fitted in an inside of the tube portion 30*a*. A member which forms the distal end portion 31 of the first tubular member 30 is fixedly attached an opening of the tube portion 30*a* at one side, and the bracket 31T is rotatably attached to the member. The nut 34 is fitted into the inside of the tube portion 30*a* via an opening of the tube portion 30*a*, the opening which is at the other side (a side at which a base portion 32 is arranged) of the tube portion 30*a*.

In a state where the nut 34 is fitted inside the tube portion 30*a*, a crimping operation is performed on the tube portion 30*a*, and accordingly a crimped portion 33 is formed at a portion of the tube portion 30*a*, the portion which is close to the base portion 32. By providing the crimped portion 33, the nut 34 and the tube portion 30*a* are integrated with each other. The nut 34 and the tube portion 30*a* may be integrated with each other by press-fitting, welding or screwing, for example.

The first tubular member 30, which is formed by the tube portion 30*a* and the nut 34 which are integrated with each other in the above-explained manners, includes the distal end portion 31 connected to the vehicle main body 2 (FIG. 8) and the base portion 32 positioned at a side which is opposite to the distal end portion 31. The tube portion 30*a* includes a length in a lengthwise direction thereof, that is, a length extending from the distal end portion 31 towards the base portion 32. The first tubular member 30 is assembled to the threaded rod 20 in such a manner that the threaded rod 20 is inserted into the inside of the first tubular member 30 (tube portion 30*a*). The first tubular member 30 is provided in such a manner that at least a part of the first tubular member 30, the part which is positioned between the distal end portion 31 and the base portion 32 (for example, an inner circumferential surface of the nut 34 in the embodiment), threadedly engages with the threaded rod 20.

For example, the length of the tube portion 30*a* is set at such a length that allows the nut 34 fitted in the inside of the tube portion 30*a* (or the base portion 32) to be positioned on the threaded rod 20 in a state where the vehicle door 3 is open most widely, in other words, in a state where the first tubular member 30 projects the most from the opening portion 11H of the holding member 11 (in the state that is indicated with the long dashed double-short dashed line in FIG. 8). The first tubular member 30 projects or protrudes outside the vehicle door 3 via the opening portion 11H provided at the attachment portion 11B and the opening portion 3H (FIG. 8) provided at the vehicle door 3. The distal end portion 31 of the first tubular member 30 is fixed to the front edge portion 2F of the vehicle main body 2 via the bracket 31T. The first tubular member 30 rotates the threaded rod 20 by moving in an axial direction relative to the threaded rod 20 in response to the opening and closing operation of the vehicle door 3.

The second tubular member 40 will be explained. As illustrated in FIGS. 7 and 8, the second tubular member 40 includes a distal end 41 and a rear end 42. An inner diameter of the second tubular member 40 is larger than an outer diameter of the first tubular member 30. Through holes 43 and 44 are provided at a portion of the second tubular member 40, the portion which is close to the rear end 42. The second tubular member 40 is inserted into the through hole 12H (FIGS. 6 and 7) of the lid member 12 (pedestal portion 12B).

As explained above, the fastening member 14 is placed by insertion in the through hole 11C (FIG. 6) of the holding member 11 (extended portion 11A). The fastening member 14 is inserted into the through hole 11C and the screw hole 12C in this mentioned order, and an end portion of the fastening member 14 is arranged inside the through hole 43 of the second tubular member 40 (FIG. 8). The fastening member 15 is placed by insertion in the through hole 11D (FIG. 6) of the holding member 11 (extended portion 11A). The fastening member 15 is inserted into the through hole 11D and the screw hole 12D in this mentioned order, and an end portion of the fastening member 15 is arranged inside the through hole 44 of the second tubular member 40 (FIG. 8). The second tubular member 40 is held by the base member 10 (lid member 12), and the second tubular member 40 and the lid member 12 (pedestal portion 12B) are configured to pivot or swing relative to each other while the position of the fastening members 14 and 15 serving as the center of the pivot.

The second tubular member 40 is assembled to the pedestal portion 12B of the lid member 12 in such a manner that the threaded rod 20 is inserted into the inside of the second tubular member 40. The second tubular member 40 is arranged so as to surround the threaded rod 20, and the first tubular member 30 is arranged between the second tubular member 40 and the threaded rod 20. A length of the second tubular member 40 is set at such a length that allows the base portion 32 of the first tubular member 30 to be positioned at the inside of the second tubular member 40 in a state where the vehicle door 3 is open most widely, in other words, in a state where the first tubular member 30 projects the most from the opening portion 11H of the holding member 11 (in the state that is indicated with the long-dashed double-short dashed line in FIG. 8).

The brake mechanism 50, the encoder 60 and the speed increasing mechanism 70 will be explained. The brake mechanism 50 is positioned at an outer side relative to the threaded rod 20 in a radial direction of the threaded rod 20, when seen from an axis of the threaded rod 20 or from a center of rotation of the threaded rod 20. In other words, the brake mechanism 50 is arranged to be next to or adjacent to the threaded rod 20 in the radial direction of the threaded rod 20.

The brake mechanism 50 is formed of, for example, an electromagnetic coil. On a path of power transmission, the speed increasing mechanism 70 is provided between the brake mechanism 50 and the threaded rod 20. The brake mechanism 50 is drive-connected to the threaded rod 20 via the speed increasing mechanism 70. The speed of the rotations of the threaded rod 20 is increased by the gears 71, 72 and 73 (FIG. 8), which form the speed increasing mechanism 70, and the rotations of which the speed has been increased are transmitted or conveyed to the brake mechanism 50. The brake mechanism 50 restricts the first tubular member 30 from moving relative to the threaded rod 20 by restricting, via the speed increasing mechanism 70, the threaded rod 20 from rotating.

The encoder 60 is connected to the threaded rod 20 via the brake mechanism 50 and the speed increasing mechanism 70, and detects a phase of the threaded rod 20 in a rotation direction of the threaded rod 20. A position of the threaded rod 20 in the axial direction is calculated on the basis of a detection result of the encoder 60, and accordingly an opening degree of the vehicle door 3 relative to the vehicle main body 2 can be specified or estimated.

Operation and effects will be described. With reference to FIG. 8, according to the door check apparatus 5, the threaded rod 20 is rotatably positioned at a predetermined position in the inside of the vehicle door 3, and the first tubular member 30 is connected to the vehicle main body 2. The first tubular member 30 moves in the axial direction in response to the opening and closing operation of the vehicle door 3. The threaded rod 20 and the first tubular member 30 threadedly engage with each other, and the linear motion of the first tubular member 30 is converted into the rotational motion of the threaded rod 20. By controlling the rotations of the threaded rod 20 with the use of the brake mechanism 50, the linear motion of the first tubular member 30 (movement of the first tubular member 30) can be stopped at an arbitrary position. Thus, the door check apparatus 5 is configured to generate a holding force at a position with an arbitrary opening degree (for example, a position at which a user stops the opening and closing operation of the vehicle door). In other words, the door check apparatus 5 is configured to generate the holding force (a resistance force against the opening and closing operation of the vehicle door 3) when the vehicle door 3 is at a position with an arbitrary opening degree relative to the vehicle main body 2.

At the door check apparatus 5, in response to the opening and closing operation of the vehicle door 3, the first tubular member 30 that is in the non-rotating state moves in the axial direction relative to the threaded rod 20 that rotates at the predetermined position at the inside of the vehicle door 3. In a state where the vehicle door 3 is open, it is configured that the first tubular member 30 is exposed outside, at the hinge portion between the vehicle main body 2 and the vehicle door 3. An outer circumferential surface of the first tubular member 30 does not include a structure which is required for the relative movement of the first tubular member 30 relative to the threaded rod 20, the structure which includes, for example, the threads. Therefore, rainwater and/or dust is not likely to attach to the substantially flat and even outer circumferential surface of the first tubular member 30. Thus, according to the door check apparatus 5, it is efficiently restricted that the rainwater and/or dust, for example, attaches to the first tubular member 30. Accordingly, the door check apparatus 5 is restricted from having malfunction and/or generating abnormal noises. Further, it is efficiently restricted that a service life of the door check apparatus 5 is shortened due to the adhesion of the rainwater and/or dust.

As explained above, the door check apparatus 5 includes the speed increasing mechanism 70 provided between the brake mechanism 50 and the threaded rod 20, and the speed increasing mechanism 70 increases the speed of the rotations of the threaded rod 20 and transmits the speed-increased rotations to the brake mechanism 50. Consequently, the brake mechanism 50 with a smaller output can be used, including for example the brake mechanism 50 with a small size, compared to a case in which the threaded rod 20 is connected directly to the brake mechanism 50.

As explained above, according to the door check apparatus 5, the brake mechanism 50 is positioned at an outer side in a direction of a radius of the rotation of the threaded rod 20 when seen from the threaded rod 20. Compared to a case in which the threaded rod 20 and the brake mechanism 50 are arranged coaxially with each other, the threaded rod 20 can be reduced in its size in the axial direction (in a direction in which the first tubular member 30 advances and retracts).

As explained above, the door check apparatus 5 is provided with the second tubular member 40 held by the base member 10. The second tubular member 40 is arranged to surround around the threaded rod 20, and the first tubular member 30 is arranged to be able to advance and retract, or move back and forth, between the second tubular member 40 and the threaded rod 20. Even in a state where the vehicle door 3 is open, it is configured that the first tubular member 30 is exposed to the outside at the hinge portion between the vehicle door 3 and the vehicle main body 2, and the dust and/or fine particles are not likely to reach the threaded rod 20 arranged at an inner side of the vehicle door 3 (at an inner side relative to the attachment portion 11B of the base member 10). With the second tubular member 40 arranged to surround the threaded rod 20, it can be even more restricted the dust and/or fine particles from reaching the threaded rod 20.

The above-explained embodiment is presented as an example and is not provided to intend to be limitative. The technical scope of the disclosure is indicated by the scope of the claims, and embraces all equivalents to the scope of claims and all variations or modifications made within the scope of claims.

According to the aforementioned embodiment, the door check apparatus 5 includes the base member 10 configured to be attached to the vehicle door 3, the threaded rod 20 rotatably held by the base member 10, and the first tubular member 30 including the distal end portion 31 configured to be connected to the vehicle main body 2, and the base portion 32 positioned at a side opposite to the distal end portion 31. The threaded rod 20 is arranged inside the first tubular member 30. At least a part of the first tubular member 30, the part which is between the distal end portion 31 and the base portion 32, threadedly engages with the threaded rod 20. The first tubular member 30 performs the relative movement in the axial direction relative to the threaded rod 20 in response to the opening and closing operation of the vehicle door 3 such that the first tubular member 30 causes the threaded rod 20 to rotate. The door check apparatus 5 includes the brake mechanism 50 configured to restrict the threaded rod 20 from rotating such that the first tubular member 30 is restricted from performing the relative movement relative to the threaded rod 20.

According to the above-described configuration, the brake mechanism 50 controls the rotations of the threaded rod 20, and thus the linear motion of the first tubular member 30 (movement of the first tubular member 30) can be stopped at an arbitrary position. In addition, at the door check apparatus 5, in response to the opening and closing operation of the vehicle door 3, the first tubular member 30 moves in the axial direction relative to the threaded rod 20 rotating at the predetermined position. In a state where the vehicle door 3 is open, it is configured that the first tubular member 30 is exposed outside, at the hinge portion between the vehicle main body 2 and the vehicle door 3. Compared to a case in which the threaded rod 20 is exposed outside, it is less likely that rainwater and/or dust is attached to the first tubular member 30.

According to the aforementioned embodiment, the door check apparatus 5 further includes the speed increasing mechanism 70 provided between the brake mechanism 50 and the threaded rod 20, on the power transmission path. The speed increasing mechanism 70 increases the speed of the rotations of the threaded rod 20 and transmits the rotations of which the speed has been increased to the brake mechanism 50.

According to the above-described configuration, compared to a case in which the threaded rod 20 is connected directly to the brake mechanism 50, the brake mechanism 50 including a smaller output, including the brake mechanism 50 of a small size, can be used, for example.

According to the aforementioned embodiment, the brake mechanism 50 is positioned at the outer side relative to the threaded rod 20 in the radial direction of the threaded rod 20 when seen from the center of rotation of the threaded rod 20.

According to the above-described configuration, compared to a case in which the threaded rod 20 and the brake mechanism 50 are arranged coaxially with each other, the threaded rod 20 can be reduced in its size in the axial direction (in the direction in which the first tubular member 30 advances and retracts).

According to the aforementioned embodiment, the door check apparatus 5 further includes the second tubular member 40 held by the base member 10. The second tubular member 40 is arranged to surround the threaded rod 20 and the first tubular member 30 is arranged between the second tubular member 40 and the threaded rod 20.

According to the above-described configuration, since the second tubular member 40 is provided to surround around the threaded rod 20, it can be restricted that the rainwater and/or dust reaches the threaded rod 20.

According to the door check apparatus 5 including the above-described configuration, the holding force can be generated relative to the vehicle door 3, at a position with an arbitrary opening degree, and the structure to which, for example, the rainwater and/or dust does not attach easily can be obtained.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door check apparatus comprising:

a base member configured to be attached to a vehicle door;

a threaded rod rotatably held by the base member;

a first tubular member including a distal end portion configured to be connected to a vehicle main body, and a base portion positioned at a side opposite to the distal end portion;

the threaded rod being arranged inside the first tubular member;

at least a part of the first tubular member, the part which is between the distal end portion and the base portion, threadedly engaging with the threaded rod;

the first tubular member performing a relative movement in an axial direction relative to the threaded rod in response to an opening and closing operation of the vehicle door such that the first tubular member causes the threaded rod to rotate; and a brake mechanism drive-connected to the threaded rod and configured to restrict the threaded rod from rotating such that the brake mechanism restricts the first tubular member from performing the relative movement relative to the threaded rod.

2. The door check apparatus according to claim 1, further comprising:

a speed increasing mechanism provided between the brake mechanism and the threaded rod, on a power transmission path; and the speed increasing mechanism transmitting rotations of the threaded rod to the brake mechanism at an increased rotational speed relative to a rotational speed of the threaded rod.

3. The door check apparatus according to claim 2, wherein the brake mechanism is positioned at an outer side relative to the threaded rod in a radial direction of the threaded rod when seen from a center of rotation of the threaded rod.

4. The door check apparatus according to claim 3, further comprising:

a second tubular member held by the base member;

the second tubular member being arranged to surround the threaded rod; and the first tubular member being arranged between the second tubular member and the threaded rod.

5. The door check apparatus according to claim 2, further comprising:

a second tubular member held by the base member;

the second tubular member being arranged to surround the threaded rod; and the first tubular member being arranged between the second tubular member and the threaded rod.

6. The door check apparatus according to claim 1, wherein the brake mechanism is positioned at an outer side relative to the threaded rod in a radial direction of the threaded rod when seen from a center of rotation of the threaded rod.

7. The door check apparatus according to claim 6, further comprising:

a second tubular member held by the base member;

the second tubular member being arranged to surround the threaded rod; and the first tubular member being arranged between the second tubular member and the threaded rod.

8. The door check apparatus according to claim 1, further comprising:

a second tubular member held by the base member;

the second tubular member being arranged to surround the threaded rod; and the first tubular member being arranged between the second tubular member and the threaded rod.

* * * * *